US005464293A

United States Patent [19]

Hall

[11] Patent Number: 5,464,293

[45] Date of Patent: Nov. 7, 1995

[54] APPARATUS FOR SUPPORTING INFORMATION TO BE READ AND FOR SEQUENTIALLY HIGHLIGHTING THE LINES OF THE SUPPORTED MATERIAL

[76] Inventor: Robert L. Hall, 7706 S. Loomis Blvd., Chicago, Ill. 60620-3750

[21] Appl. No.: 295,402

[22] Filed: Aug. 25, 1994

[51] Int. Cl.[6] ..... B41J 29/15

[52] U.S. Cl. ..... 400/718; 248/441.1

[58] Field of Search ..... 400/718; 248/442, 248/441.1

[56] References Cited

U.S. PATENT DOCUMENTS

| | | | |
|---|---|---|---|
| 679,386 | 7/1901 | Lawton | 400/718 |
| 2,523,755 | 9/1950 | Ford et al. | 400/718 |
| 2,739,569 | 3/1956 | Brazee | 400/718 |
| 4,894,756 | 1/1990 | Jan | 248/441.1 |
| 5,052,650 | 10/1991 | Beile et al. | 400/718 |

FOREIGN PATENT DOCUMENTS

| | | | |
|---|---|---|---|
| 0279572 | 12/1986 | Japan | 400/718 |

*Primary Examiner*—Edgar S. Burr
*Assistant Examiner*—Anthony H. Nguyen

[57] ABSTRACT

An apparatus for supporting information to be read and for sequentially highlighting the lines of the supported material comprising a support plate positionable in a generally vertical orientation having a front surface adapted to receive and support material to be read; a line bar slidably coupled to one edge of the support plate, the line bar having a portion positionable across a horizontal strip of the front face of the device to sequentially highlight lines to be read, the support bar adapted to be moved downwardly in response to the actions of an operator; frictional components at the edge of the line bar received in the track, the frictional components adapted to retain the line bar at a particular elevational orientation where last set but to move downwardly vertically in response to an exterior force; a vertically extending stepping bar secured to the rear face of the support plate adjacent to the track the stepping bar including spaced recesses for receiving the locking bar, each recess having a shoulder above and a cam beneath, the stepping bar having a spring urging it to an upward position, the spring being coupled between the edge of the stepping bar and the support plate; and a trigger secured to the stepping bar through a slot in the side of the support plate under the control of an operator to move the stepping bar downwardly against the action of the spring to urge the locking bar downwardly a predetermined distance equivalent to the space between the recesses whereby, when the trigger is released, the spring will urge the stepping bar upwardly and the line bar will remain at its preset orientation as it moves outwardly from the stepping bar through the action of the cam.

5 Claims, 4 Drawing Sheets

APPARATUS FOR SUPPORTING INFORMATION TO BE READ AND FOR SEQUENTIALLY HIGHLIGHTING THE LINES OF THE SUPPORTED MATERIAL

BACKGROUND OF THE INVENTION

1. Field of the Invention

The present invention relates to an apparatus for supporting information to be read and for sequentially highlighting the lines of the supported material and more particularly pertains to highlighting sequential areas of supported sheet material and to moving the highlighting at the discretion of the reader.

2. Description of the Prior Art

The use of devices of various designs and constructions for supporting and highlighting areas of sheet material to be viewed is known in the prior art. More specifically, devices of various designs and constructions for supporting and highlighting areas of sheet material to be viewed heretofore devised and utilized for the purpose of assisting readers include a wide variety of methods and apparatuses which are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,215,396 to Rogers a position finding overlay for forms.

U.S. Pat. No. 5,149,047 to Tucker discloses a foldable add-on easel with spring page holders for bookcovers/folders, with a line guide attachment.

U.S. Pat. No. 5,052,650 to Belle also discloses a copyholder.

U.S. Pat. No. 4,860,456 to Arnao discloses a forms layout gauge.

U.S. Pat. No. 4,682,749 to Strater discloses an adjustable copyholder with articulated arms.

In this respect, the apparatus for supporting information to be read and for sequentially highlighting the line of the supporting material through the simplified action of the typist according to the present invention substantially departs from the conventional concepts and designs of the prior art, and in doing so provides an apparatus primarily developed for the purpose of highlighting sequential areas of supported sheet material and to moving the highlighting at the discretion of the reader.

Therefore, it can be appreciated that there exists a continuing need for new and improved apparatus for supporting information to be read and for sequentially highlighting the lines of the supported material through the simplified action of the typist which can be used for highlighting sequential areas of supported sheet material and for moving the highlighting at the discretion of the reader. In this regard, the present invention substantially fulfills this need.

SUMMARY OF THE INVENTION

In view of the foregoing disadvantages inherent in the known types of devices of various designs and constructions for supporting and highlighting areas of sheet material to be viewed now present in the prior art, the present invention provides an improved apparatus for supporting information to be read and for sequentially highlighting the line of the supporting material through the simplified action of the typist. As such, the general purpose of the present invention, which will be described subsequently in greater detail, is to provide a new and improved apparatus for supporting information to be read and for sequentially highlighting the line of the supporting material through the simplified action of the typist and method which has all the advantages of the prior art and none of the disadvantages.

To attain this, the present invention essentially comprises a new and improved apparatus for supporting information to be read and for sequentially highlighting the lines of the supported material through the simplified action of the typist comprising, in combination, a support plate positionable in a generally vertical orientation having a front surface adapted to receive and support material to be read, the device having a support secured to the rear face thereof for maintaining the front face at an angle of about 10 degrees from the vertical, the plate having a generally vertical track along one edge; a clip at the upper end of the support plate on the front face to receive and support the sheet material to be read; a line bar slidably coupled to one edge of the support plate, the line bar having a transparent portion positionable across a horizontal strip of the front face of the device to sequentially highlight lines to be read, the support bar adapted to be moved downwardly in response to the actions of an operator; frictional components at the edge of the line bar received in the track, the frictional components adapted to retain the line bar at a particular elevational orientation where last set but to move downwardly vertically in response to an exterior force; adjustment fingers coupled to the frictional components with a spring to hold the fingers apart and the frictional components together whereby a user may squeeze the fingers to release the frictional components to vertically adjust the line bar, the adjustment fingers also including a horizontal locking bar; a vertically extending stepping bar secured to the rear face of the support plate adjacent to the track the stepping bar including spaced recesses for receiving the locking bar, each recess having a shoulder above and a cam beneath, the stepping bar having a spring urging it to an upward position, the spring being coupled between the edge of the stepping bar and the support plate; and a trigger secured to the stepping bar through a slot in the side of the support plate under the control of an operator to move the stepping bar downwardly against the action of the spring to urge the locking bar downwardly a predetermined distance equivalent to the space between the recesses whereby, when the trigger is released, the spring will urge the stepping bar upwardly and the line bar will remain at its preset orientation as it moves outwardly from the stepping bar through the action of the cam.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for supporting information to be read and for sequentially highlighting the line of the supporting material through the simplified action of the typist which have all the advantages of the prior art devices of various designs and constructions for supporting and highlighting areas of sheet material to be viewed and none of the disadvantages.

It is another object of the present invention to provide a new and improved apparatus for supporting information to be read and for sequentially highlighting the line of the supporting material through the simplified action of the typist which may be easily and efficiently manufactured and marketed.

It is further object of the present invention to provide a new and improved apparatus for supporting information to be read and for sequentially highlighting the lines of the supported material through the simplified action of the typist which is of durable and reliable constructions.

An even further object of the present invention is to provide a new and improved apparatus for supporting information to be read and for sequentially highlighting the lines of the supported material through the simplified action of the typist which is susceptible of a low cost of manufacture with regard to both materials and labor, and which accordingly is then susceptible of low prices of sale to the consuming public, thereby making such apparatus economically available to the buying public.

Still yet another object of the present invention is to provide a new and improved apparatus for supporting information to be read and for sequentially highlighting the line of the supported material through the simplified action of the typist which provides in the apparatuses and methods of the prior art some of the advantages thereof, while simultaneously overcoming some of the disadvantages normally associated therewith.

Still another object of the present invention is to highlight sequential areas of supported sheet material and to move the highlighting at the discretion of the reader.

Lastly, it is an object of the present invention to provide new and improved apparatus for supporting information to be read and for sequentially highlighting the lines of the supported material comprising a support plate positionable in a generally vertical orientation having a front surface adapted to receive and support material to be read; a line bar slidably coupled to one edge of the support plate, the line bar having a portion positionable across a horizontal strip of the front face of the device to sequentially highlight lines to be read, the support bar adapted to be moved downwardly in response to the actions of an operator; frictional components at the edge of the line bar received in the track, the frictional components adapted to retain the line bar at a particular elevational orientation where last set but to move downwardly vertically in response to an exterior force; a vertically extending stepping bar secured to the rear face of the support plate adjacent to the track the stepping bar including spaced recesses for receiving the locking bar, each recess having a shoulder above and a cam beneath, the stepping bar having a spring urging it to an upward position, the spring being coupled between the edge of the stepping bar and the support plate; and a trigger secured to the stepping bar through a slot in the side of the support plate under the control of an operator to move the stepping bar downwardly against the action of the spring to urge the locking bar downwardly a predetermined distance equivalent to the space between the recesses whereby, when the trigger is released, the spring will urge the stepping bar upwardly and the line bar will remain at its preset orientation as it moves outwardly from the stepping bar through the action of the cam.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
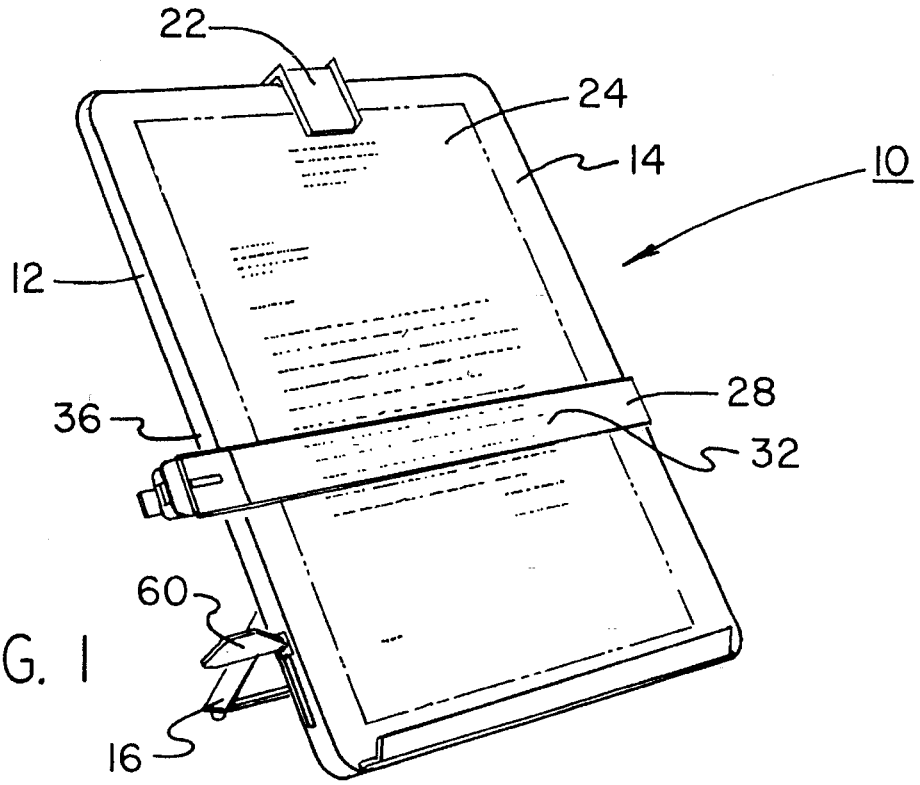
FIG. 1 is a perspective view of the preferred embodiment of the apparatus for supporting information to be read and for sequentially highlighting the line of the supporting material through the simplified action of the typist constructed in accordance with the principles of the present invention.
Figure 2:
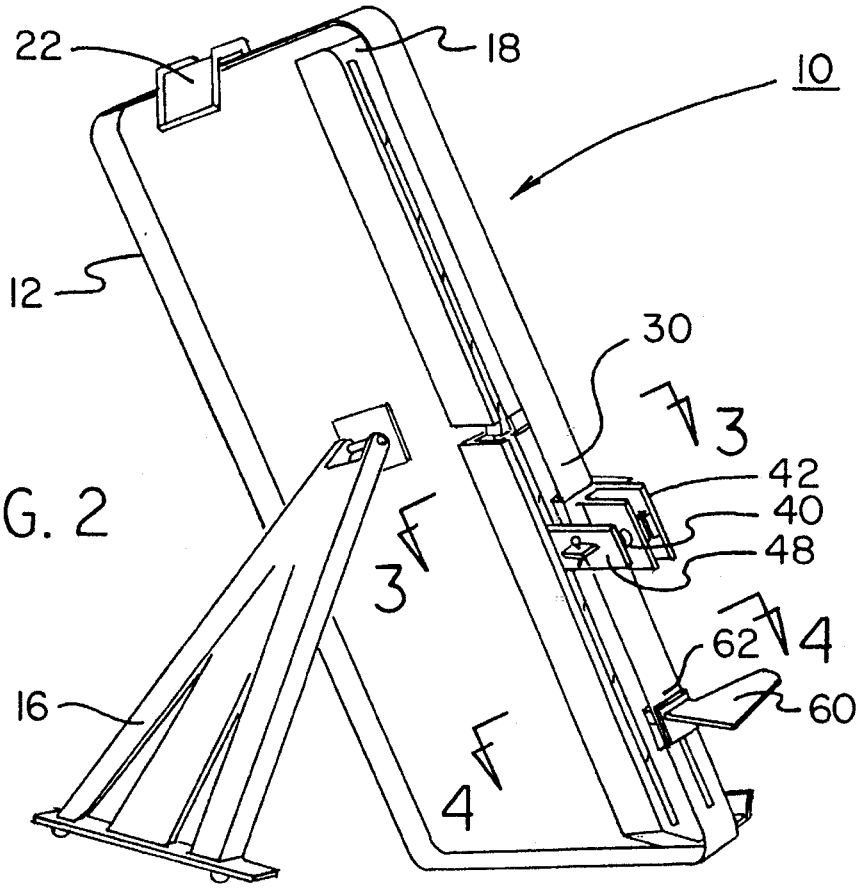
FIG. 2 is a rear perspective view of the device shown in FIG. 1.
Figure 3:
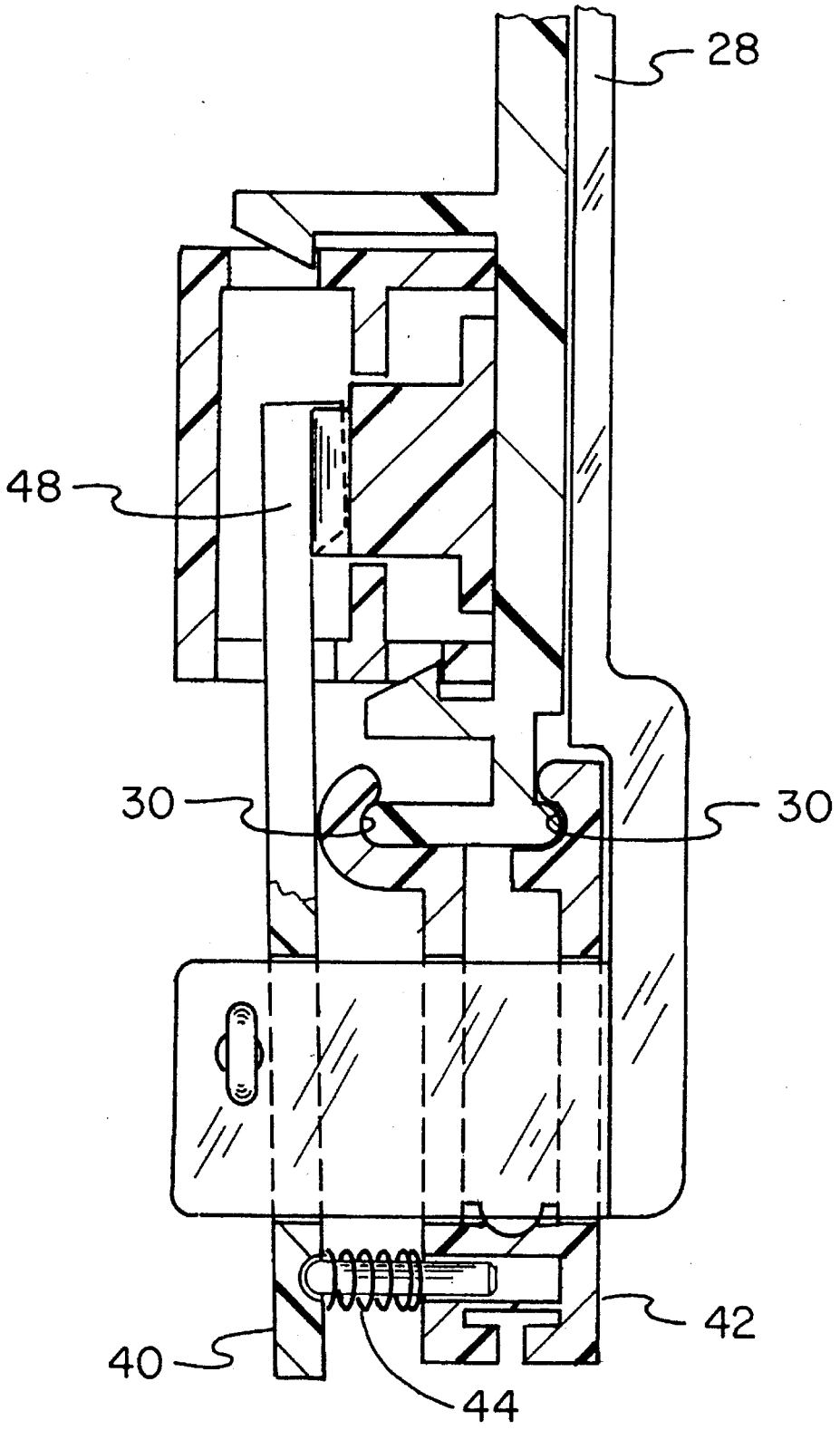
FIG. 3 is a cross sectional view of the device taken along line 3—3 of FIG. 2.
Figure 4:
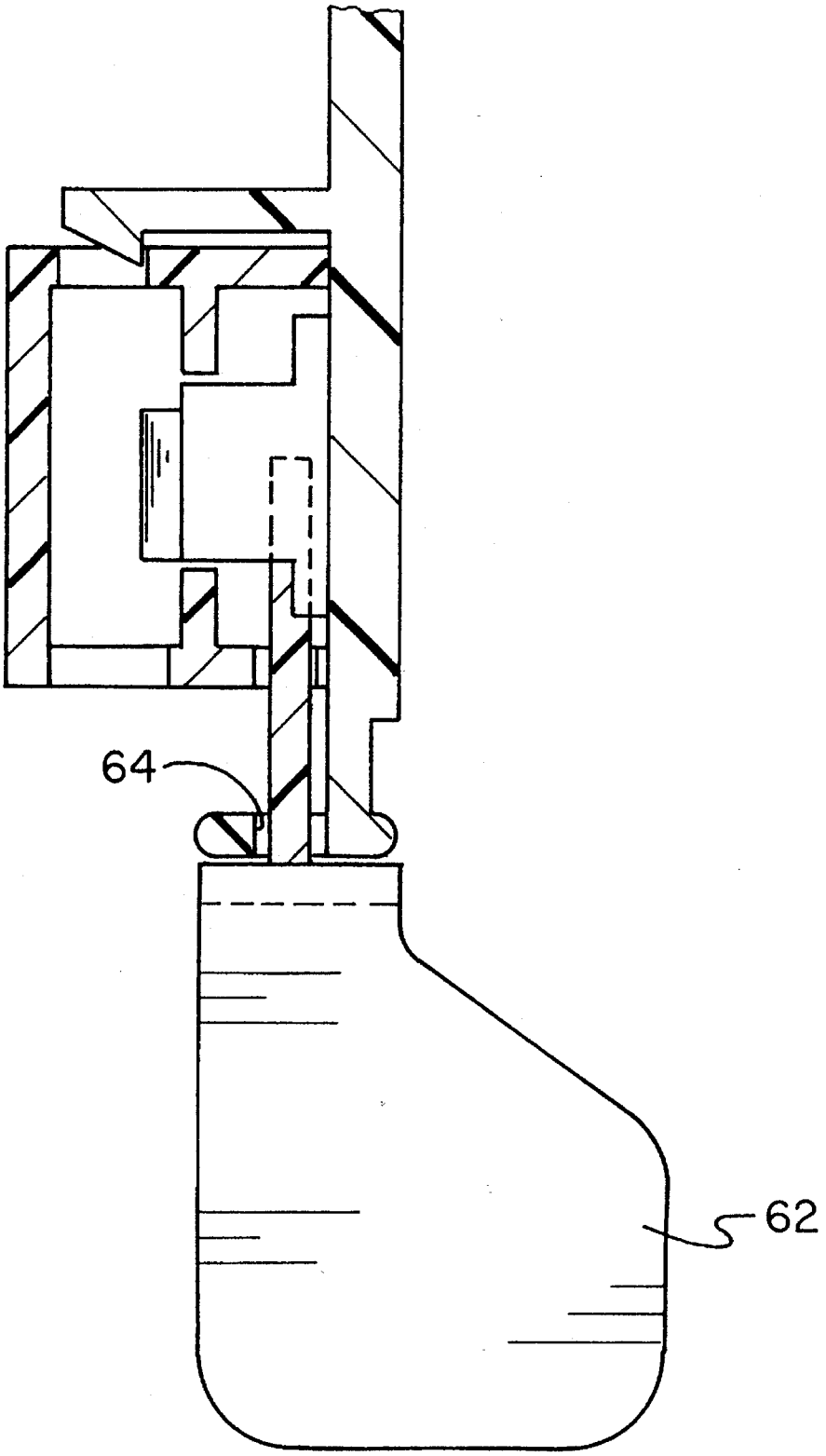
FIG. 4 is a cross sectional view of the device taken along line 4—4 of FIG. 2.
Figure 5:
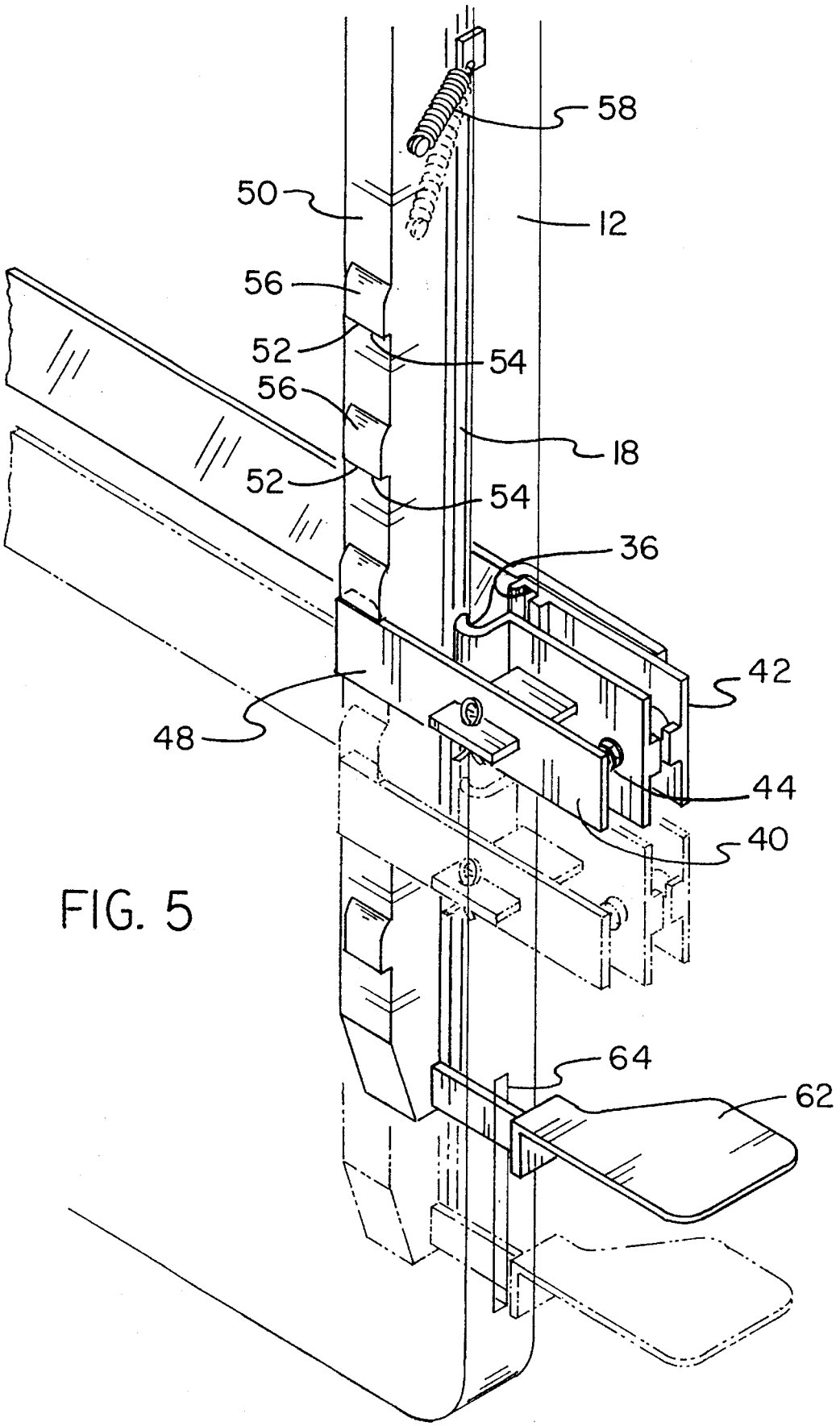
FIG. 5 is an enlarged perspective view of the rear components of the device of FIGS. 1 and 2 with parts removed to show certain internal constructions thereof.

With reference now to the drawings, and in particular to FIGS. 1 through 5 thereof, the preferred embodiment of the new and improved lowtitle embodying the principles and concepts of the present invention and generally designated by the reference numeral 10 will be described.

The present invention, the new and improved apparatus for supporting information to be read and for sequentially highlighting the lines of the supported material, is a system comprised of a plurality of components. The components in their broadest context include a support plate, clip, line bar, frictional components, adjustment fingers, stepping bar and trigger. Each of the individual components is specifically configured and correlated one with respect to the other to attain the desired objectives.

The central component of the system 10 of the present invention is a support plate 12. The support plate is positionable in a generally vertical orientation. It has a front surface 14 adapted to receive and support material to be read. The device also has a support 16 pivotally secured to the rear face. The support is for maintaining the front face at an appropriate angle of about ten degrees from the vertical for the convenience of reading. The plate also has a generally vertical track 18 along one edge, preferably the left edge when viewing the front surface.

Located at the upper edge of the front surface of the support plate is a clip 22. The clip is at the upper end of the plate at the front surface at a location to receive and support the sheet material 24 adapted to be read with the line to be read being highlighted as described herein.

Highlighting is effected through a line bar 28. The line bar is slidably coupled to one edge 30 of the support plate for movement vertically while maintaining a horizontal orientation. The line bar has a transparent central portion 32 positioned across a horizontal strip of the front face of the device and the sheet material to be highlighted and read. The transparent section is to sequentially highlight the specific lines of the document supported therebeneath to be read. The support bar is also adapted to be moved downwardly a predetermined distance in response to the actions of an operator as will be described hereinafter.

Frictional components 36 are pivotally secured at the edge of the line bar. Such components are received in the track. They are adapted to retain the line bar at a particular elevational orientation where last set by an operator. They are also adapted to move downwardly a predetermined distance in a vertical direction in response to an exerted force in response to the actions of an operator.

Adjustment fingers 40, 42 are coupled to the frictional components. A spring 44 holds the fingers apart during normal operation. By holding the fingers apart, interior components will urge together the frictional components. In this manner, a user may squeeze the fingers together to release the frictional components temporarily. When so released, the vertical adjustment of the line bar is capable. The adjustment fingers also include a horizontal locking bar 46 extending behind the support plate at the edge thereof adjacent to the track.

The next operative component of the system is a vertically extending stepping bar 50. The stepping bar is secured to the rear face of the support plate adjacent to the track. The stepping bar includes spaced recesses 52 for receiving the locking bar. Each recess has a shoulder 54 at its upper edge constituting an abutment surface. Each recess also has a cam 56 formed as an angled surface at its lower edge. In addition, the stepping bar has a spring 58 urging it to an upward position. The spring is coupled between the edge of the stepping bar and the support plate.

The last operating component of the system 10 is a trigger 62. The trigger is secured to the stepping bar. It extends through a slot 64 in the side of the support plate. The trigger is a horizontal surface 66 under the control of an operator. When depressed by an operator, the trigger will move the stepping bar downwardly against the action of the spring. This urges the locking bar downwardly a predetermined distance equivalent to the space between the recesses. In this manner, when the trigger is released, the spring will urge the stepping bar upwardly and the support bar will remain at its preset orientation. When this occurs, the locking bar will move outwardly from the stepping bar through the action of the cam. As such, the adjustment fingers allow for incremental adjustment of the line bar while the trigger will allow for the incremental stepping of the line bar.

The present invention consists of an easel, a clip, a trigger, and a line guide. The prop on the easel portion of the unit extends back about 80 degrees to keep the easel at a comfortable angle. The clamp at the top keeps the paper copy in place. The line indicator portion of the unit is positioned on the side of the easel and held in place by a clamp. It can be move up and down to highlight the lines of data on the paper. The trigger moves the indicator down once it has been positioned over the paper. Pressing the trigger down gently will cause the indicator bar to move down 1½ inches on the paper. It can be moved for a shorter length just by releasing the trigger before the bar moves down the full 1½ inches.

Both the trigger indicator and the indicator bar move up and down in a track which runs down the left side of the easel. A clog and spring mechanism inside the track keeps the trigger and the latch in place and allows them to be repositioned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for supporting information to be read and for sequentially highlighting the lines of the supported material through the simplified action of the typist comprising, in combination:

a support plate positionable in a generally vertical orientation having a front surface adapted to receive and support material to be read, the device having a support secured to the rear face thereof for maintaining the front face at an angle of about 10 degrees from the vertical, the plate having a generally vertical track along one edge;

a clip at the upper end of the support plate on the front face to receive and support the sheet material to be read;

a line bar slidably coupled to one edge of the support plate, the line bar having a transparent portion positionable across a horizontal strip of the front face of the device to sequentially highlight lines to be read, the support bar adapted to be moved downwardly in response to the actions of an operator;

frictional components at the edge of the line bar received in the track, the frictional components adapted to retain the line bar at a particular elevational orientation where last set but to move downwardly vertically in response to an exterior force;

adjustment fingers coupled to the frictional components with a spring to hold the fingers apart and the frictional components together whereby a user may squeeze the fingers to release the frictional components to vertically adjust the line bar, the adjustment fingers also including a horizontal locking bar;

a vertically extending stepping bar secured to the rear face of the support plate adjacent to the track the stepping bar including spaced recesses for receiving the locking bar, each recess having a shoulder above and a cam beneath, the stepping bar having a spring urging it to an upward position, the spring being coupled between the edge of the stepping bar and the support plate; and a trigger secured to the stepping bar through a slot in the side of the support plate under the control of an operator to move the stepping bar downwardly against the action of the spring to urge the locking bar downwardly a predetermined distance equivalent to the space between the recesses whereby, when the trigger is released, the spring will urge the stepping bar upwardly and the line bar will remain at its preset orientation as it moves outwardly from the stepping bar through the action of the cam.

2. An apparatus for supporting information to be read and for sequentially highlighting the lines of the supported material, comprising:

a support plate positionable in a generally vertical orientation having a front surface adapted to receive and support material to be read;

a line bar slidably coupled to one edge of the support plate, the line bar having a portion positionable across a horizontal strip of the front face of the device to sequentially highlight lines to be read, the support bar adapted to be moved downwardly in response to the actions of an operator;

frictional components at the edge of the line bar received in the track, the frictional components adapted to retain the line bar at a particular elevational orientation where last set but to move downwardly vertically in response to an exterior force;

a vertically extending stepping bar secured to the rear face of the support plate adjacent to the track the stepping bar including spaced recesses for receiving the locking bar, each recess having a shoulder above and a cam beneath, the stepping bar having a spring urging it to an upward position, the spring being coupled between the edge of the stepping bar and the support plate; and a trigger secured to the stepping bar through a slot in the side of the support plate under the control of an operator to move the stepping bar downwardly against the action of the spring to urge the locking bar downwardly a predetermined distance equivalent to the space between the recesses whereby, when the trigger is released, the spring will urge the stepping bar upwardly and the line bar will remain at its preset orientation as it moves outwardly from the stepping bar through the action of the cam.

3. The device as set forth in claim 2 and further including:

a support secured to the rear face thereof for maintaining the front face at an angle of about 10 degrees from the vertical, the plate having a generally vertical track along one edge.

4. The device as set forth in claim 2 and further including:

a clip at the upper end of the support plate on the front face to receive and support the sheet material to be read.

5. The device as set forth in claim 2 and further including:

adjustment fingers coupled to the frictional components with a spring to hold the fingers apart and the frictional components together whereby a user may squeeze the fingers to release the frictional components to vertically adjust the line bar, the adjustment fingers also including a horizontal locking bar.

* * * * *